United States Patent [19]

Alexander et al.

[11] 4,346,009

[45] * Aug. 24, 1982

[54] CENTRIFUGAL SPIN-ON FILTER OR SEPARATOR

[75] Inventors: Willis R. Alexander, Hagerstown, Md.; Robert J. Shaltis, Hastings, Mich.

[73] Assignees: Hastings Manufacturing Co., Hastings, Mich.; Mack Trucks, Allentown, Pa.

[ * ] Notice: The portion of the term of this patent subsequent to Aug. 18, 1998, has been disclaimed.

[21] Appl. No.: 283,475

[22] Filed: Jul. 15, 1981

Related U.S. Application Data

[63] Continuation-in-part of Ser. No. 82,548, Oct. 9, 1979, Pat. No. 4,284,504.

[51] Int. Cl.[3] ..... B04B 9/00

[52] U.S. Cl. ..... 210/512.1; 233/23 R; 233/47 R

[58] Field of Search ..... 210/512.1, 168, 448, 210/440, 266; 233/1, 20, 23, 27, 47; 29/598, 609

[56] References Cited

U.S. PATENT DOCUMENTS

| | | | |
|---|---|---|---|
| 3,645,402 | 2/1972 | Alexander et al. | 210/266 |
| 3,726,403 | 4/1973 | Shaltis | 210/440 |
| 3,784,092 | 1/1974 | Gibson | 233/20 R |
| 4,046,315 | 9/1977 | Klingenberg | 233/21 |
| 4,106,689 | 8/1978 | Kozulla | 233/23 R |
| 4,165,032 | 8/1979 | Klingenberg | 233 23 R/ |
| 4,284,504 | 8/1981 | Alexander et al. | 210/168 |

*Primary Examiner*—Ernest G. Therkorn

*Attorney, Agent, or Firm*—Munson H. Lane, Jr.

[57] ABSTRACT

An oil separator cartridge includes a cylindrical spin-on housing having opposite inlet and outlet ends connected by an intermediate wall with the inlet end including a threaded aperture threadably mountable on an engine oil output tube having a smooth cylindrical outer end surface; a centrifugal separator rotor unit is mounted on an axially shiftable shaft in the housing for rotation and axial reciprocation for receiving oil from the oil output tube. A coil spring mounted in the housing urges the axially shiftable shaft and the centrifugal separator rotor unit toward the inlet with a force of sufficient strength to normally overcome the axial force exerted on the rotor unit by oil under normal pressure in the oil output tube; however, the coil spring permits the rotor unit to axially move away from the inlet in response to pressure surges above said normal pressure in the oil output tube to cushion the effect of such pressure surges on the cartridge. A sealing means is mounted in sealing engagement with the oil output tube for precluding the bypass or leakage flow of oil directly into the housing for all axial positions of the rotor unit.

14 Claims, 4 Drawing Figures

CENTRIFUGAL SPIN-ON FILTER OR SEPARATOR

CROSS-REFERENCE TO RELATED APPLICATION

This application is a continuation-in-part of our earlier copending application Ser. No. 82,548, filed Oct. 9, 1979, now U.S. Pat. No. 4,284,504, issued Aug. 18, 1981, the disclosure of which is incorporated herein by reference.

BACKGROUND OF THE INVENTION

Centrifugal filters or separators have been in use for a substantial time but have suffered from problems such as excessive cost of manufacture, difficulty of assembly, and functional inadequacy. Often the prior known separators include clamping mechanisms which are spring-loaded to the extent that tools are usually required in removing portions of the housing to permit access to the internal operating elements of the separator. In addition, threaded rods and nuts are usually included to secure the shafts and other portions of the rotary unit to the remainder of the housing on or adjacent to the engine. This has made those separators relatively expensive to manufacture because of the complexity of the parts involved and difficult to operate because of the nature of the attachment mechanisms particularly.

Not only the construction and assembly, but also the mode of operation of prior known separators has been deficient in several areas. Proper flow paths may not always be established to ensure that the particles within the oil being treated are thrown toward the peripheral portions of the rotary unit. In addition, the centrifugal force imparted to the oil as it leaves the rotary unit often causes the oil to swirl as it is delivered from the separator to the engine. The swirl remaining with the oil as it is dispensed from the separator reduces the effectiveness of the oil because the desired flow pattern is not always achieved.

Another problem inherent in prior known separators results from the fact that pressure surges occur in the oil output line from the engine so as to subject the cartridge and its internal rotor unit, etc., to substantial suddenly applied forces. It has consequently been necessary to employ relatively heavy and consequently more expensive materials than would be necessary if it were not for the forces resultant from pressure surges encountered in the usual operation of many devices of this type. The rotor units of devices of the type disclosed in our aforementioned prior application Ser. No. 82,548, now U.S. Pat. No. 4,284,504, must normally be held in position by a relatively strong spring having sufficient strength to completely resist the force exerted by the oil pressure to which the units are normally subjected. However, pressure surges can occur to move the rotor unit and permit the dumping of the incoming oil into the housing externally of the rotor unit so as to cause the dirty oil to be recirculated to the engine.

Therefore, it is the primary object of this invention to provide a new and improved oil purifying and separating apparatus.

SUMMARY OF THE INVENTION

Achievement of the foregoing object of the invention is enabled by the preferred embodiment through the provision of a generally cylindrical spin-on housing having opposite inlet and outlet ends with the inlet end including a threaded aperture mountable on an engine oil output tube having a smooth outer end surface. A centrifugal separator rotor unit is mounted for rotation on an axially shiftable shaft in the housing for receiving oil from the oil output tube. Reaction jets on the rotor unit effect rotation of the unit in a well-known manner and a coil spring is mounted on a coil spring carrier in a lower portion of the housing for urging the axially shiftable shaft on which the rotor unit is mounted upwardly toward the inlet end. A metal cup is mounted on the upper end of the axially shiftable shaft and supports an annular seal means sealingly engaging and encircling the lower smooth end of the engine oil output tube. During normal operation, the coil spring maintains the rotor unit and its supporting axially shiftable shaft in an upper position. However, when a pressure surge occurs, the force of the spring is overcome and the rotor unit and its supporting shaft are shifted downwardly against the compressive force of the spring to absorb the shock of the pressure surge. The sealing means provided in the metal cup remains in sealing contact with the outer surface of the engine oil output tube so as to preclude any leakage of oil from the tube into the housing in the area external of the rotor unit. This construction provides a substantial advantage over prior known centrifugal separator units in that it permits the use of a lighter weight spring than was previously the case and precludes the dumping of excess oil into the housing for direct return to the engine. The use of a lighter spring in turn makes the device much more easy to assemble since the assembly of the device requires a certain amount of compression of the spring member.

Therefore, it will be seen that the present invention represents a distinct step forward in the art in permitting the achievement of the improved functional results of absorbing the shock of pressure surges and avoiding direct return of dirty oil to the engine while simultaneously achieving economy of fabrication.

DESCRIPTION OF THE PREFERRED EMBODIMENTS

Figure 1:
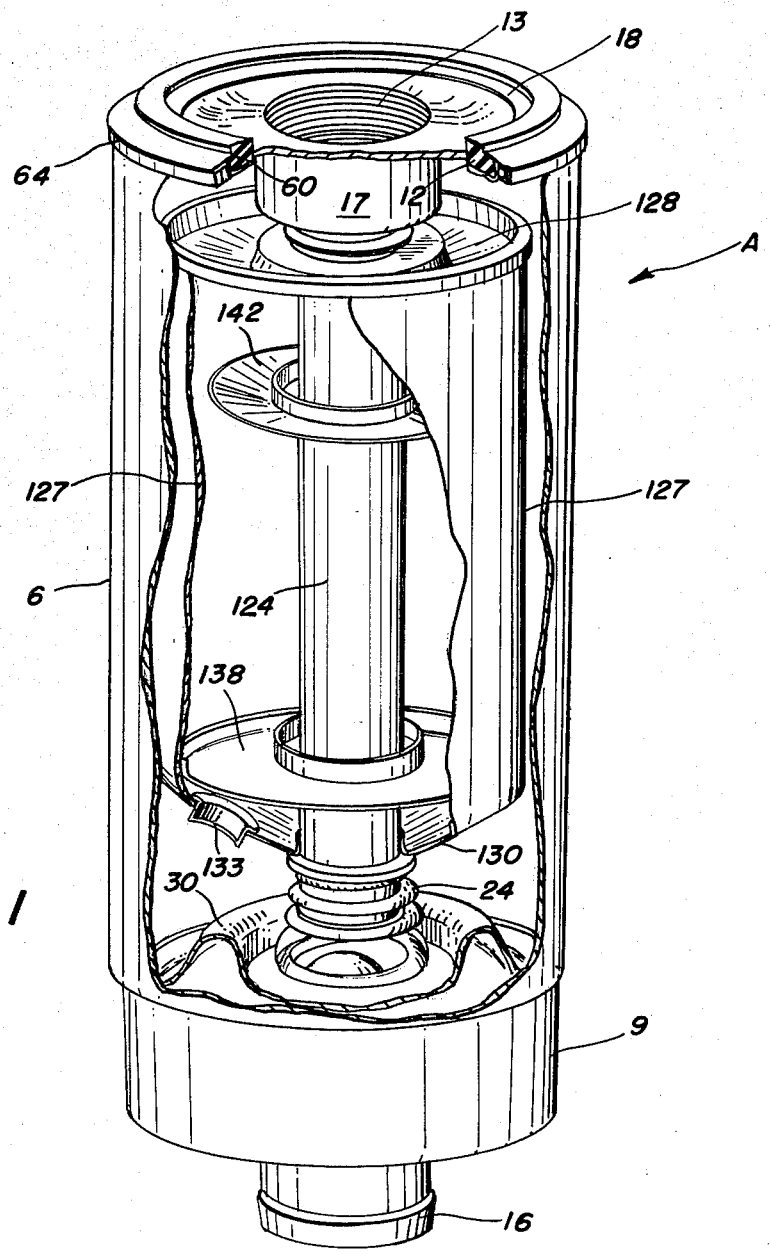
FIG. 1 is a perspective view of a first embodiment of the invention with portions removed for the purpose of illustrating the internal components.

The preferred embodiment of the invention which is illustrated in FIG. 1 consists of a cartridge comprising a generally cylindrical housing 6 formed of metal and including a canted shoulder surface 7 separating an upper larger diameter portion 8 from a lower smaller diameter portion 9. The lower end of the housing comprises a rounded base 10 from which an outlet tube 16 extends. The opposite or upper end of the housing 6 is closed by a heavy cover 12 formed of plastic having a perimeter snugly fitted in the upper end of the housing.

Cover 12 is held in position against upward movement by an anular spun-on metal collar 18 sealingly joined to the upper end of large diameter portion 8 at 64 which includes an annular seat in which a flexible elastomeric seal ring 60 is mounted. Screw threads 13 are provided in a downwardly extending inlet tube 15 defining an axial opening in the cover 12 so that the housing can be threadably connected to the threaded oil output tube 120 (FIG. 4) of a conventional engine block oil filter coupler housing 122 with the annular seal ring 160 being forced against the coupler housing 122 to achieve a sealed connection therewith. It should be observed that the threaded oil output tube 120 has a smooth non-threaded lower end surface 123 and the inlet tube 15 has a similar smooth outer surface over which the smooth inner surface of a metal guide cup 17 is matingly fitted for limited axial reciprocation in a manner to be discussed.

Figure 3:
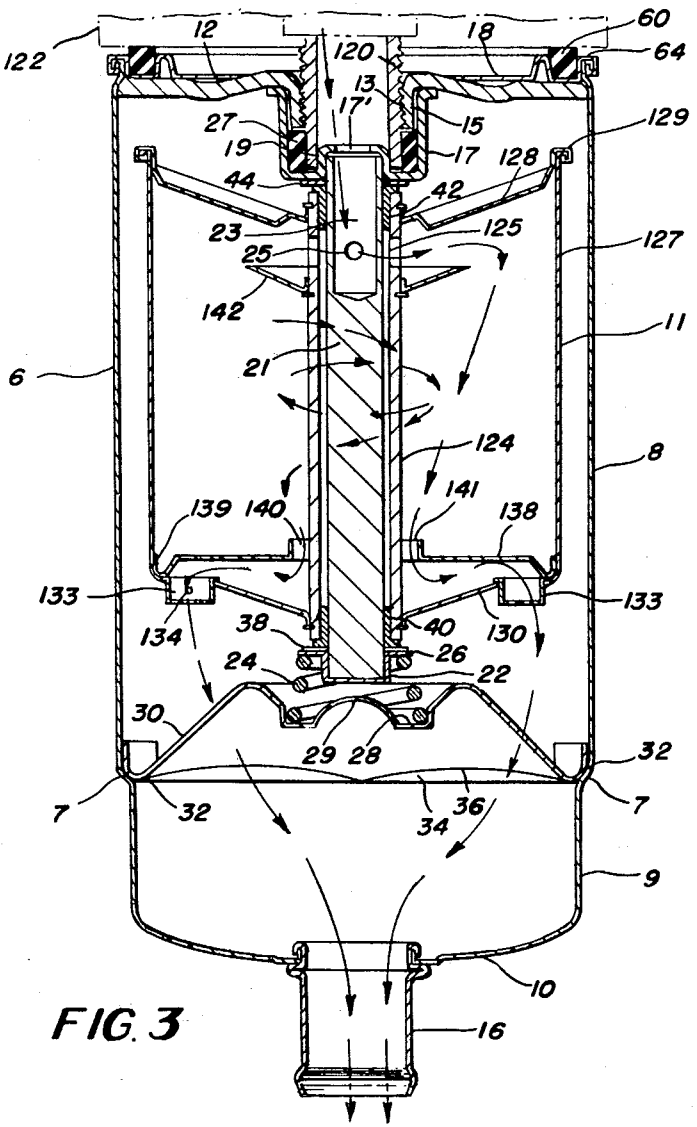
FIG. 3 is a bisecting sectional view of the embodiment of FIG. 1 illustrating the components in the position assumed during normal flow pressure operation.

Cup 17 includes an upwardly extending axially concentric center dome portion 19 having an axial aperture 17′ for receiving oil from oil output tube 120. An axially shiftable rotor carrier shaft 21 having an axially extending end chamber 23 provided in its upper end has its upper end press fitted in the upwardly extending center dome portion 19 of the metal cup 17. An annular elastomeric seal 27 is provided on the interior of the cup 17 to have its upper end normally engage the lower end of the inlet tube 15 as shown in FIG. 3 with the inner surface of the seal engaging the smooth surface 123 of oil output tube 120. Flow openings 25 extend through the wall of shaft 21 to chamber 23.

The lower end of the rotor carrier shaft 21 is positioned in a cup 22 which is biased upwardly by a relatively weak coil spring 24 engaging a radial peripheral flange 26 of the cup 22. The coil spring 24 is of conical configuration with its lower and larger end resting in an annular trough 28 surrounding a dome 29 formed in a spring supporting pedestal 30 of somewhat conical configuration having foot portions 32 resting on the canted shoulder surface 7 of the housing 6 so as to be supported thereby. However, it should be observed that slots 34 are provided between lower edge surfaces 36 of the spring supporting pedestal 30 and the housing 6 for permitting the flow of oil from the upper portion of the housing downwardly through the slots 34 for discharge via the outlet tube 16. A thrust washer 38 rests on the radial peripheral flange 26 and supports a lower bearing 40 mounted on and encircling the shaft 21. An upper bearing 42 is mounted on the upper end of shaft 21 and engages an upper thrust washer 44 which in turn contacts the lower surface of the metal cup 17. Thus, it will be seen that the rotor carrier shaft 21 is supported and urged upwardly by spring 24 so that the parts are normally as shown in FIG. 3.

The axially shiftable rotor carrier shaft 21 provides support for a centrifugal separator rotor unit 11 supported between the lower bearing 40 and the upper bearing 42 for rotation about the axis of shaft 21. Rotor unit 11 includes a foraminous sleeve 124 carried between and mounted on the bearings 40 and 42 for rotation thereon for supporting the remaining rotor components. More specifically, an outer cylindrical wall portion 127 is connected to the foraminous sleeve 124 at its upper end by a downwardly sloping upper end cover 128 connected to the cylindrical wall portion by a spun joint 129. The lower end of the rotor unit 11 is integrally formed with the cylindrical wall portion 127 and comprises a downwardly and inwardly sloping bottom wall 130 which is sealingly and fixedly secured to the lower end of the foraminous sleeve 124.

First and second reaction jet cups 133 are mounted in apertures in the downwardly and inwardly sloping bottom wall 130 and may be secured thereto in any suitable manner such as by welding or epoxy adhesive. Each reaction jet cup has a jet aperture 134 from which high pressure oil is ejected to effect rotation of the rotor unit in a manner well known to those of skill in the art and described, for example, in U.S. Pat. No. 3,762,633.

A baffle plate 138 is positioned above the sloping bottom wall 130 and is adhesively or otherwise secured to the wall by an upturned flange 139 and has an upwardly extending collar 141 spaced from and axially surrounding the foraminous sleeve 124. Collar 141 defines an opening 140 through which oil can flow downwardly in the rotor in a manner to be described. Additionally, an upper smaller diameter baffle plate 142 is secured to the foraminous sleeve 124 at a location beneath apertures 125 formed therein in general alignment with the flow openings 25 of the shaft 21.

During normal operation of the preferred embodiment, the parts are in the positions illustrated in FIG. 3 and oil from the oil output tube 120 flows through the opening 17′ into the end chamber 23 of the rotor carrier shaft 21. The oil then passes outwardly through flow openings 25 and openings 125 into the upper chamber of the rotor unit 11 (the portion of the interior of the housing above the baffle plate 138) from which it is discharged through annular opening 140 into the lower chamber beneath the baffle 138. Oil in the lower chamber enters the reaction jet cups 133 and is forcefully discharged through the jet openings 134 to effect rotation of the rotor unit 11 in a well-known manner. Rotation of the rotor unit results in the solid particles in the oil being centrifugally spread and positioned about the inner surface of the outer cylindrical wall portion 127 whereas the lighter liquid components flow downwardly through the annular opening 140 into the lower chamber for discharge through jet openings 134. The oil from the jet openings 134 flows downwardly through the slots 34 to exit from the housing via the outlet tube 16 from which it flows to the sump.

The parts remain in the position shown in FIG. 3 during normal operation due to the fact that the spring 24 is sufficiently strong to resist the force exerted by the oil pressure downwardly on shaft 21 during such normal operation.

Figure 4:
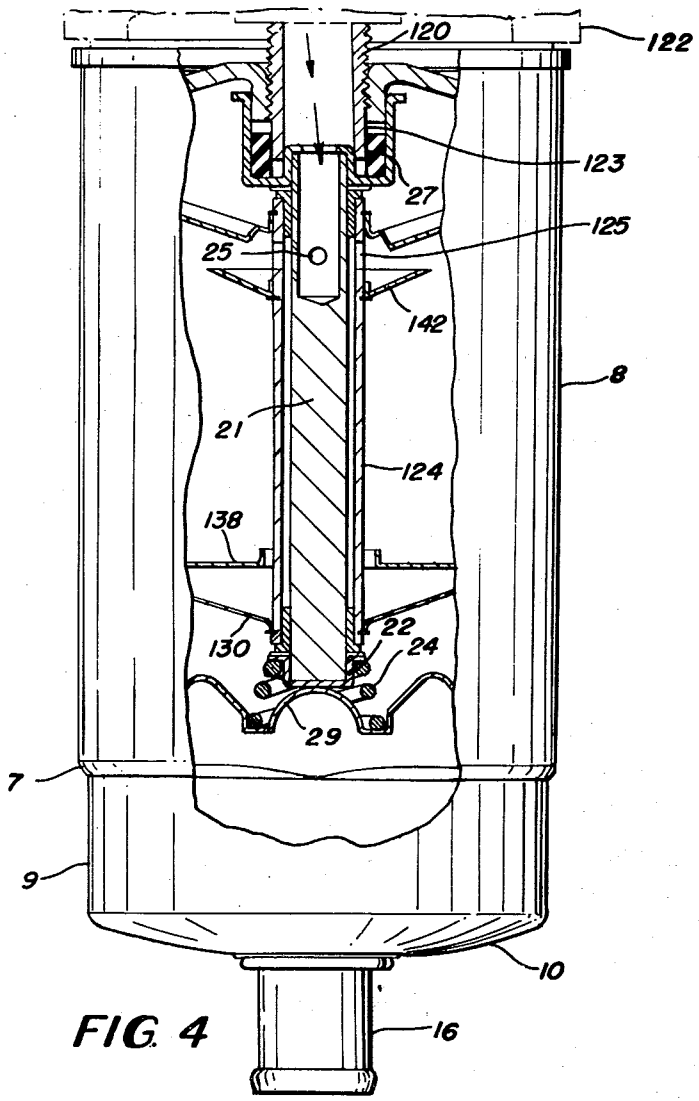
FIG. 4 is a cut-away view including a bisecting sectional section throught the middle of the apparatus of FIG. 1 illustrating the components in the position assumed during a pressure-surge condition.

However, the oil pressure in the oil output tube 120 sometimes increases rapidly and dramatically so as to create a pressure surge which causes an excessive force to be applied to the shaft 21 to move it downwardly from the position of FIG. 3 to the position of FIG. 4. Such movement occurs when the pressure results in a force of sufficient magnitude to overcome the biasing force of spring 24. Engagement of the cap 22 with the dome 29 of the spring carrier 30 limits the amount of downward movement of the shaft 21; however, it should be noted that the spring carrier 30 is itself somewhat resilient and is capable of providing a cushioning effect upon engagement of the dome 29 by the cap 22. Thus, spring 24 acts as a cushion to lessen the shock effect of pressure surges to consequently smooth out and reduce the force applied to the cartridge during such surges. A functionally beneficial result from the use of the axially shiftable rotor carrier shaft 22 and the associated rotor unit 11 is consequently achieved. It should be noted that the seal 27 remains in sealing contact with the lower smooth surface 123 of the oil output tube 120 when the shaft 21 is in its lower position of FIG. 4.

Moreover, the construction of the preferred embodiment also provides a substantial advantage in terms of overall cost of components and assembly expense in that it permits the use of a smaller spring for urging the rotor unit upwardly. Since the force of the spring must be overcome during the assembly of the device, the preferred embodiment in using a weaker spring is substantially easier to assemble than are prior devices requiring the use of stronger springs having sufficient strength to maintain the components in a fixed upward position during all stages of operation including pressure surges.

Figure 2:
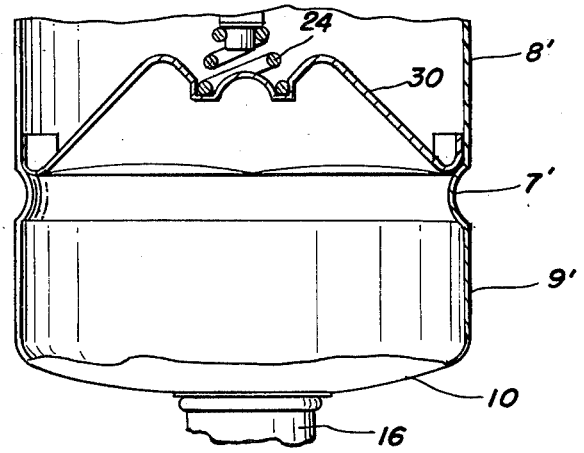
FIG. 2 is a bisecting sectional view of the bottom portion of a second embodiment of the invention.

FIG. 2 illustrates a second embodiment of the invention in which the outer wall of the housing comprises an upper wall portion 8' and a lower wall portion 9' of equal diameter. An annular indentation 7' separates the wall components 8' and 9' to provide a canted support surface for the spring pedestal 30. Otherwise, the embodiment of FIG. 2 is identical to the embodiment of FIGS. 1, 3, and 4 and is operative in the same manner.

Although the preferred embodiments of the invention have been disclosed in detail, it should be understood that numerous modifications and variations of these embodiments will undoubtedly occur to those of skill in the art and the spirit and scope of the invention is to be limited solely by the appended claims.

We claim:

1. An oil separator cartridge comprising a cylindrical spin-on housing having opposite inlet and outlet ends connected by an intermediate wall, said inlet end including a threaded aperture being threadably mountable on an oil output tube having a smooth cylindrical outer end surface, a centrifugal separator rotor unit mounted for rotation and axial reciprocation within said housing for receiving oil from said oil output tube, biasing means urging said centrifugal separator rotor unit toward said inlet with a force of sufficient strength to normally overcome the axial force exerted on said centrifugal separator rotor unit by oil under normal pressure in said oil output tube but permitting said centrifugal separator rotor unit to axially move away from said inlet in response to pressure surges above said normal pressure in said oil output tube so as to cushion the effect of such pressure surges on said cartridge, and sealing means mounted within said cartridge for maintaining sealing engagement with said oil output tube for precluding bypass or leakage flow of oil from said oil output tube directly into said housing for all axial positions of said centrifugal separator rotor unit.

2. An oil separator cartridge as recited in claim 1 wherein said centrifugal separator rotor unit is mounted for rotation on an axially shiftable rotor carrier shaft having first and second ends extending lengthwise of said cartridge and said biassing means comprises a coil compression spring means engaging the first end of said rotor carrier shaft.

3. An oil separator cartridge as recited in claim 2 wherein said inlet end comprises a cover having an inwardly extending inlet tube and wherein said threaded aperture is formed in said inwardly extending inlet tube and further including a guide cup attached to the second end of said rotor carrier shaft and matingly fitted about the outer periphery of said inlet tube for axial sliding movement thereon.

4. An oil separator cartridge as recited in claim 1 wherein said rotor unit includes reaction jet cups for providing rotation effecting force thereto.

5. An oil separator cartridge as recited in claim 1 wherein said centrifugal separator rotor unit includes a foraminous sleeve which is mounted for rotation on an axially shiftable rotor carrier shaft mounted in said housing having first and second ends extending lengthwise of said cartridge, said biassing means comprising a coil compression spring means engaging the first end of said rotor carrier shaft and further including an axially extending end chamber in said first end of said rotor carrier shaft facing said oil output tube for receiving oil therefrom and radial outflow openings in said axially shiftable rotor carrier shaft for directing oil outwardly through said foraminous sleeve into the interior of said centrifugal separator rotor unit.

6. An oil separator cartridge as recited in claim 5 wherein said inlet end comprises a cover having an inwardly extending inlet tube and wherein said threaded aperture is formed in said inwardly extending inlet tube and further including a guide cup attached to the second end of said rotor carrier shaft and matingly fitted about the outer periphery of said inlet tube for axial sliding movement thereon.

7. An oil separator cartridge as recited in claim 1 wherein said rotor unit includes reaction jet cups for providing rotation effecting force thereto and wherein said sealing means is an annular sealing means mounted in encircling sealing engagement with a lower end portion of said oil output tube for axial movement therealong during axial movement of the rotor unit.

8. An oil separator cartridge comprising a cylindrical spin-on housing having opposite inlet and outlet ends connected by an intermediate wall, said inlet end including a threaded aperture being threadably mountable on an oil output tube having a smooth cylindrical outer end surface, a centrifugal separator rotor unit mounted for rotation and axial reciprocation within said housing for receiving oil from said oil output tube, biassing means urging said centrifugal separator rotor unit toward said inlet with a force of sufficient strength to normally overcome the axial force exerted on said centrifugal separator rotor unit by oil under normal pressure in said oil output tube but permitting said centrifugal separator rotor unit to axially move away from said inlet in response to pressure surges above said normal pressure in said oil output tube so as to cushion the effect of such pressure surges on said cartridge, and sealing means mounted within said cartridge for maintaining sealing engagement with said oil output tube for precluding bypass or leakage flow of oil from said oil output tube directly into said housing for all axial positions of said centrifugal separator rotor unit, said centrifugal separator rotor unit being mounted for rotation on an axially shiftable rotor carrier shaft having first and second ends extending lengthwise of said cartridge and said biassing means comprising a coil compression spring means engaging the first end of said rotor carrier shaft, said inlet end comprising a cover having an inwardly extending inlet tube, said threaded aperture being formed in said inwardly extending inlet tube, a guide cup attached to the second end of said rotor carrier shaft and matingly fitted about the outer periphery of said inlet tube for axial sliding movement thereon, said guide cup including an upwardly extending center dome portion having an axial aperture for receiving oil from said oil output tube, said second end of said rotor carrier shaft being fixedly positioned in said center dome portion and including an inflow chamber extending axially inward from said second end of said shaft for receiving oil from said axial aperture in said guide cup.

9. An oil separator as recited in claim 8 wherein said sealing means comprises an annular elastomeric seal positioned on the interior of said guide cup in surrounding spaced relation to said center dome portion in sealing contact with the smooth cylindrical outer end surface of said oil output tube.

10. An oil separator as recited in claim 9 wherein said housing comprises an outer wall including an upper large diameter cylindrical wall section, a lower smaller diameter cylindrical wall section and a canted shoulder portion connecting said wall sections, and additionally including a spring carrier having foot portions resting on said canted shoulder portion and an axial recess in its upper portion in which one end of said coil spring spaced from said rotor carrier shaft is positioned.

11. An oil separator as recited in claim 9 wherein said housing comprises an outer cylindrical wall including an annular indentation providing a canted support surface and additionally including a spring carrier having foot portions resting on said canted support surface and an axial recess in its upper portion in which one end of said coil spring spaced from said rotor carrier shaft is positioned.

12. An oil separator cartridge comprising a cylindrical spin-on housing having opposite inlet and outlet ends connected by an intermediate wall, said inlet end including a threaded aperture being threadably mountable on an oil output tube having a smooth cylindrical outer end surface, a centrifugal separator rotor unit mounted for rotation and axial reciprocation within said housing for receiving oil from said oil output tube, biassing means urging said centrifugal separator rotor unit toward said inlet with a force of sufficient strength to normally overcome the axial force exerted on said centrifugal separator rotor unit by oil under normal pressure in said oil output tube but permitting said centrifugal separator rotor unit to axially move away from said inlet in response to pressure surges above said normal pressure in said oil output tube so as to cushion the effect of such pressure surges on said cartridge, and sealing means mounted within said cartridge for maintaining sealing engagement with said oil output tube for precluding bypass or leakage flow of oil from said oil output tube directly into said housing for all axial positions of said centrifugal separator rotor unit, said centrifugal separator rotor unit including reaction jet cups for providing rotation effecting force thereto, a foraminous sleeve which is mounted for rotation on an axially shiftable rotor carrier shaft mounted in said housing having first and second ends extending lengthwise of said cartridge, said biassing means comprising a coil compression spring means engaging the first end of said rotor carrier shaft and further including an axially extending end chamber in said first end of said rotor carrier shaft facing said oil output tube for receiving oil therefrom and radial outflow openings in said axially shiftable rotor carrier shaft for directing oil outwardly through said foraminous sleeve into the interior of said centrifugal separator rotor unit, said inlet end comprising a cover having an inwardly extending inlet tube, said threaded aperture being formed in said inwardly extending inlet tube, a guide cup attached to the second end of said rotor carrier shaft and matingly fitted about the outer periphery of said inlet tube for axial sliding movement thereon, said guide cup including an upwardly extending center dome portion having an axial aperture for receiving oil from said oil output tube, said second end of said rotor carrier shaft being fixedly positioned in said center dome portion.

13. An oil separator as recited in claim 12 wherein said sealing means comprises an annular elastomeric seal positioned on the interior of said guide cup in surrounding spaced relation to said center dome portion in sealing contact with the smooth cylindrical outer end surface of said oil output tube.

14. An oil separator as recited in claim 13 wherein said housing comprises an outer wall including an upper large diameter cylindrical wall section, a lower smaller diameter cylindrical wall section and a canted shoulder portion connecting said wall sections, and additionally including a spring carrier having foot portions resting on said canted shoulder portion and an axial recess in its upper portion in which one end of said coil spring spaced from said rotor carrier shaft is positioned.

* * * * *